US008732993B2

(12) United States Patent
Hruska et al.

(10) Patent No.: US 8,732,993 B2
(45) Date of Patent: May 27, 2014

(54) EARTH SHAPING APPARATUS FOR DITCHING AND LEVELING

(75) Inventors: Kevin Hruska, Gerald (CA); Raymond Helmeczi, Esterhazy (CA)

(73) Assignee: Bridgeview Mfg. Inc., Gerald, Saskatchewan (CA)

( * ) Notice: Subject to any disclaimer, the term of this patent is extended or adjusted under 35 U.S.C. 154(b) by 362 days.

(21) Appl. No.: 13/212,920

(22) Filed: Aug. 18, 2011

(65) Prior Publication Data

US 2012/0311894 A1 Dec. 13, 2012

(51) Int. Cl.
*A01B 13/00* (2006.01)
*E02F 5/02* (2006.01)

(52) U.S. Cl.
USPC ..... 37/372

(58) Field of Classification Search
USPC ..... 37/367, 347, 380, 404, 408, 444, 403, 37/368–372; 172/197, 199, 396, 605, 200, 172/784, 788, 785, 799.5
See application file for complete search history.

(56) References Cited

U.S. PATENT DOCUMENTS 632,060 A 8/1899 Ponton et al.
850,006 A 4/1907 Howell
2,726,463 A 12/1955 Rogers
3,608,643 A 9/1971 Flood et al.
4,091,629 A 5/1978 Gunn et al.
4,217,962 A * 8/1980 Schaefer ..... 172/197
4,834,191 A 5/1989 Vecchio
6,067,733 A * 5/2000 Gasper ..... 37/367

OTHER PUBLICATIONS

Canadian Office Action for Canadian Application No. 2742573, Dated May 15, 2012.
Canadian Office Action for Canadian Patent Application No. 2,742,573, Dated Oct. 17, 2011.
Canadian Office Action for Canadian Patent Application No. 2,742,573, Dated Jan. 23 , 2012.

* cited by examiner

*Primary Examiner* — Robert Pezzuto
(74) *Attorney, Agent, or Firm* — Stetina Brunda Garred & Brucker

(57) ABSTRACT

An earth shaping apparatus allows a ditch to be excavated and the surrounding area leveled in a single pass. The earth shaping apparatus has a leveling blade with an elongated lower contacting edge that is adapted to be moved in a ditching direction. The lower contacting edge is arranged at an angle to the ditching direction. The earth shaping apparatus further has a ditching blade coupled to the earth shaping apparatus in front of the leveling blade with respect to the ditching direction. The ditching blade has a contacting edge extending below the lower contacting edge of the leveling blade when in use.

20 Claims, 5 Drawing Sheets

EARTH SHAPING APPARATUS FOR DITCHING AND LEVELING

CROSS-REFERENCE TO RELATED APPLICATIONS

The present application claims priority to Canadian Patent No. 2,742,573 entitled EARTH SHAPING APPARATUS FOR DITCHING AND LEVELING filed Jun. 10, 2011.

STATEMENT RE: FEDERALLY SPONSORED RESEARCH/DEVELOPMENT

Not Applicable

BACKGROUND OF THE INVENTION

1. Technical Field of the Invention

The current description relates to an earth shaping apparatus, and in particular to an earth shaping apparatus capable of producing a leveled ditch.

2. Description of the Related Art

Shaping land for a particular purpose can involve digging or otherwise creating a ditch. The ditch may be used, for example, for irrigation, drainage or marking of boundary lines.

Various ditching devices for creating a ditch exist. For example, a powered ditcher may use a rotating member to remove material from the ditch. Due to the powered nature of the ditcher, the overburden material removed from the ditch may be deposited away from the excavated ditch. Such powered ditchers require moving parts to create the ditch, and these moving are susceptible to breakage, especially in rocky terrains, where hitting a large rock may damage the ditching device.

Another ditching device is a V-ditcher, which comprises a V-shaped implement that is designed to be pulled behind a vehicle such as a tractor and driven into the ground. The V-shape causes material to be pushed out of the ditch. However, unlike the powered ditching devices, which can eject the material from the surrounding ditch, the V-ditcher causes the overburden material to form a berm on either side of the ditch. The berm may be undesirable in various situations. For example, a berm can act as a dam preventing water from entering the ditch, and as such may need to be removed if the ditch is to be used for drainage. The berm may be removed from the ditch by a leveler or scrapper that can be pulled over the ditch to level the berm. However, this requires passing over the ditch using a second implement, which effectively doubles the amount of work required to create the ditch. Furthermore, the leveler or scrapper will cause material from the berm to also fall back into the excavated ditch.

What is need is an implement that can provide a leveled ditch in a single pass in a wide range of conditions.

BRIEF SUMMARY OF THE INVENTION

In accordance with the present disclosure there is provided an earth shaping apparatus comprising: a leveling blade having an elongated lower contacting edge and adapted to be moved in a ditching direction, the lower contacting edge arranged at an angle to the ditching direction; and a ditching blade coupled to the earth shaping apparatus in front of the leveling blade with respect to the ditching direction, the ditching blade having a contacting edge extending below the lower contacting edge of the leveling blade when in use.

BRIEF DESCRIPTION OF THE DRAWINGS

Embodiments are described herein with reference to the appended drawings, in which.

DETAILED DESCRIPTION OF THE INVENTION

Figure 1:
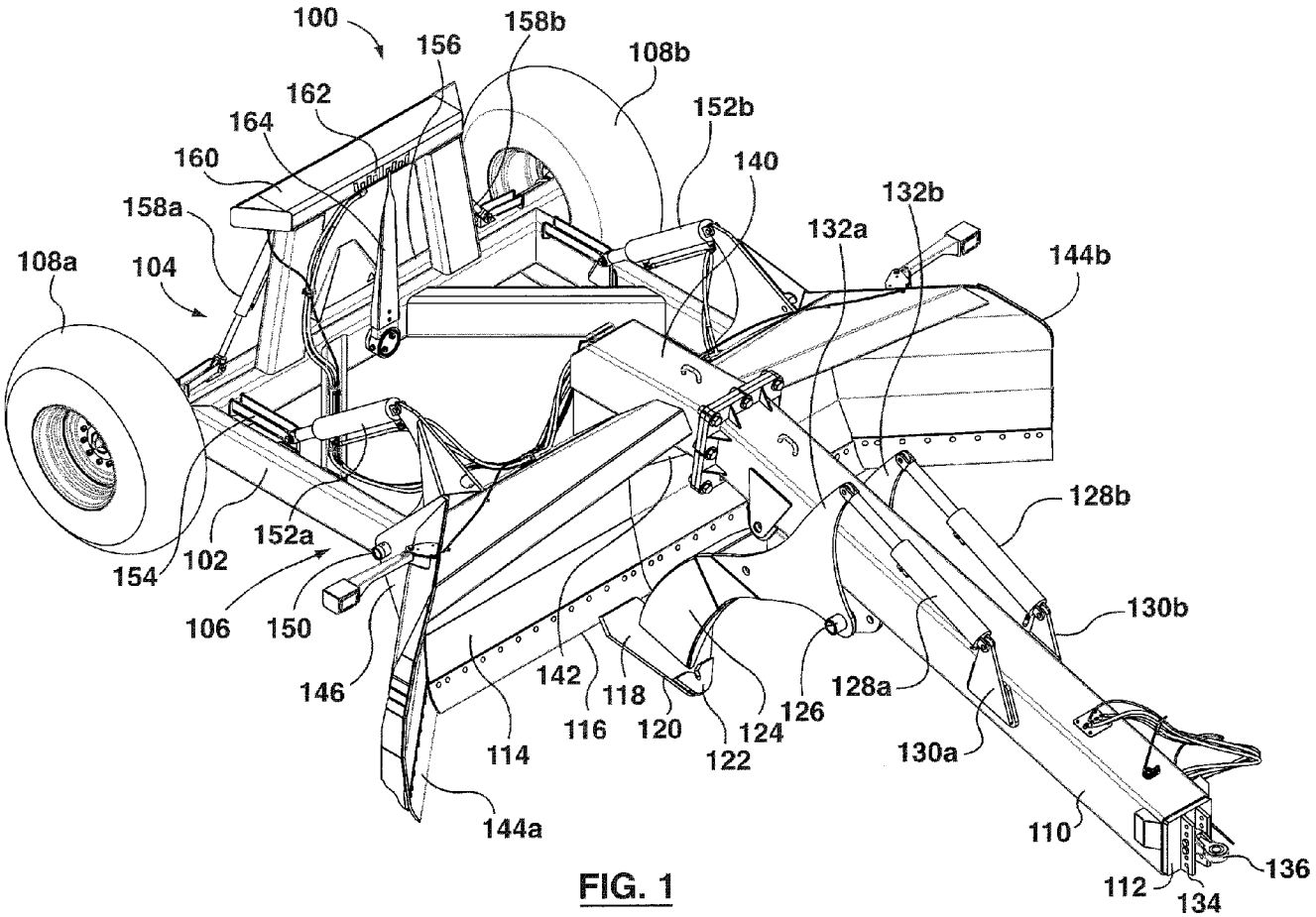
FIG. 1 depicts a perspective view of an earth shaping apparatus.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

An earth shaping apparatus, referred to further herein as a ditcher for brevity, is described that is capable of producing a ditch and leveling the surrounding ground, including the overburden material removed from the ditch, in a single pass.

A first embodiment of a ditcher will be described with reference to FIGS. 1 to 4. The ditcher 100 comprises a frame 102 that provides a support and mounting structure for other components of the ditcher 100. The frame 102 has a rearward section 104 and a forward section 106. The rearward section 104 and forward section 106 are relative to the intended ditching-direction of the ditcher during operation. A pair of wheels 108*a*, 108*b* (referred to collectively as wheels 108) are mounted to the frame 102 at the rearward section 104. The wheels 108 allow the ditcher 100 to be pulled by a tow vehicle (not shown). A hitch 110 is coupled to the frame 102 at the forward section 106 of the frame 102. The hitch 110 includes a front end 112 that is adapted to be connected to the tow vehicle.

The ditcher 100 also includes a leveling blade 114 that may have a substantially flat lower contacting edge 116. The leveling blade 114 provides an elongated member that extends generally transverse to the ditching-direction of the ditcher. It is contemplated that the angle of the leveling blade relative to the ditching-direction of the ditcher may vary. For example the leveling blade 114 may be at an angle of between 45° and 135° relative to the ditching-direction. The lower contacting edge 116 of the leveling blade 114 contacts the ground and levels the earth by removing material from high points of the ground and spreading this overburden material into depressions or low points of the ground as the leveling blade 114 is pulled in the ditching-direction.

The ditcher 100 further includes a ditching blade 118 mounted between the front end of the hitch 112 and the leveling blade 114. The ditching blade 118 is depicted as being positioned in the approximate center of the leveling blade 114. It is contemplated that the ditching blade 118 could also be located off-center. The ditching blade 118 has a V-shaped contacting edge 120 that extends down below the lower contacting edge 116 of the leveling blade 114 when in use. By locating the ditching blade 118 between the front end of the hitch 112 and the leveling blade 114, the ditching blade 118 will be in front of the leveling blade 114 when the ditcher 100 is being pulled in the ditching-direction by the tow vehicle. As such, when the ditching blade 118 extends below the lower contacting edge 116 of the leveling blade 114 it will force material from the ditch and deposit the overburden material in berms on either side of the ditch. The leveling blade 114 will then level the deposited material, forming a leveled ditch in a single pass.

In order to ensure that the overburden material deposited in berms by the ditching blade 118 is not deposited back into the excavated ditch by the leveling blade 114, the ditching blade 118 can be located in close proximity to the leveling blade 114 so that the excavated material, or a substantial portion thereof, cannot fall back into the ditch and will be spread out by the leveling blade 114. Although the ditching blade 118 is located in close proximity to the leveling blade 114, it does not need to be in contact with the leveling blade 114. The distance separating the ditching blade 118 from the leveling blade 114 may vary. For example it may be located approximately 1 inch to 1½ inches from the leveling blade 114. It is contemplated that the ditching blade 118 may be located further away from the leveling blade 114, however it should be located close enough to prevent a substantial portion of the material excavated from the ditch from being deposited back into the ditch by the leveling blade 114. The portion of the material that is required to be prevented from falling into the excavated ditch may vary depending on the requirements of the application.

The ditching blade 118 may include a protective piece of material 122 on the leading edge of the ditching blade 118. The protective piece of material 122 may be a sacrificial piece of metal that can be easily replaced in order to prolong the operating lifetime of the ditcher 100. The protective piece of material 122 conforms to the V-shape of the contacting edge 120 of the ditching blade 118.

As depicted in FIG. 1, the ditching blade 118 may be adjustably mounted to the ditcher 100 to allow adjustment of an amount of the ditching blade 118 that extends below the lower contacting edge 116 of the leveling blade 114 during operation. By adjusting the amount that the ditching blade 118 extends below the lower contacting 116 edge of the leveling blade 114, the depth of the ditch excavated can be adjusted. The ditching blade 118 may also be fully retracted so that it does not extend below the lower contacting edge 116 of the leveling blade 114 at all, allowing the ditcher 100 to function solely for leveling the earth.

In order to allow adjustment of the height of the ditching blade 118 that extends below the lower contacting edge 116 of the leveling blade 114, it may be mounted to the ditcher 100 by a ditching leg 124. The ditching leg 124 may be pivotally connected to the hitch 110 at a pivot point 126. The height of the ditching blade 118 may be controlled using hydraulic pistons 128*a*, 128*b* (referred to collectively as hydraulic pistons 128). Although two hydraulic pistons 128 are depicted it is considered that a single hydraulic piston could be used. One end of the hydraulic pistons 128 is connected to the hitch 110 by mounting plates 130*a*, 130*b* (referred to collectively as mounting plates 130) that are secured to the hitch 110. The other end of each of the hydraulic pistons 128 is connected to actuating arms 132*a*, 132*b* (referred to collectively as actuating arms 132) of the ditching leg 124. When the hydraulic pistons 128 are extended or retracted, the actuating arms 132 are displaced about the connecting pivot point 126, which causes the ditching leg 124 to pivot about the pivot point 126 and thereby adjust the amount the ditching blade 118 extends above or below the lower contacting edge 116 of the leveling blade 114.

The ditcher leg 124 may be assembled from two, long identically cut legs. The legs vaguely resemble a 'Y' shape, with one arm of the 'Y' providing a location for the pivot point 126, which may be a hole for connecting a bushing pin of the pivot, and the other arm of the 'Y' providing the actuating arm 130. The bottom of the leg of the 'Y' provides a mounting location for the ditching blade 118. The ditching blade 118 may be provided by a V-shaped plate of steel. Each 'Y' shaped leg is bent equal and opposite to each other, thus making them mirrored pieces. The bends of the individual legs are contoured so that a top section of the 'Y' shape of each leg, including both the pivot point and the actuating arm, are parallel when the ditching leg is assembled while a bottom section of the 'Y' shape of each leg comes to a forward-facing edge at the bottom. The forward-facing edge at the bottom of the ditching leg provides a similar V-shape to the ditching blade 118.

The ditching blade 118 is formed from a strong, triangular plate attached generally perpendicular to the bottom of the ditching leg 124. To reinforce the tip of the ditching blade, the triangular plate may have a piece of steel 122 welded on to protect the main 'V' shaped contacting edge 120 of the triangular plate from wearing away. This reinforcement tip 122 is a consumable part which can be replaced as it wears down. For added protection, the space between the bottom portion of the 'Y' shaped legs may be plated. This may include covering a front, back, and top of the bottom section of the ditching leg 124 to provide a substantially sealed section of the ditching leg 124. This covering prevents dirt and debris from entering the inside corners of the ditching leg 124 where it could rust and would be hard to clean. The ditching leg 124 may be open at a top section, for example where the tops of the legs are parallel to each other, where cleaning is easier to prevent rusting.

Figure 2:
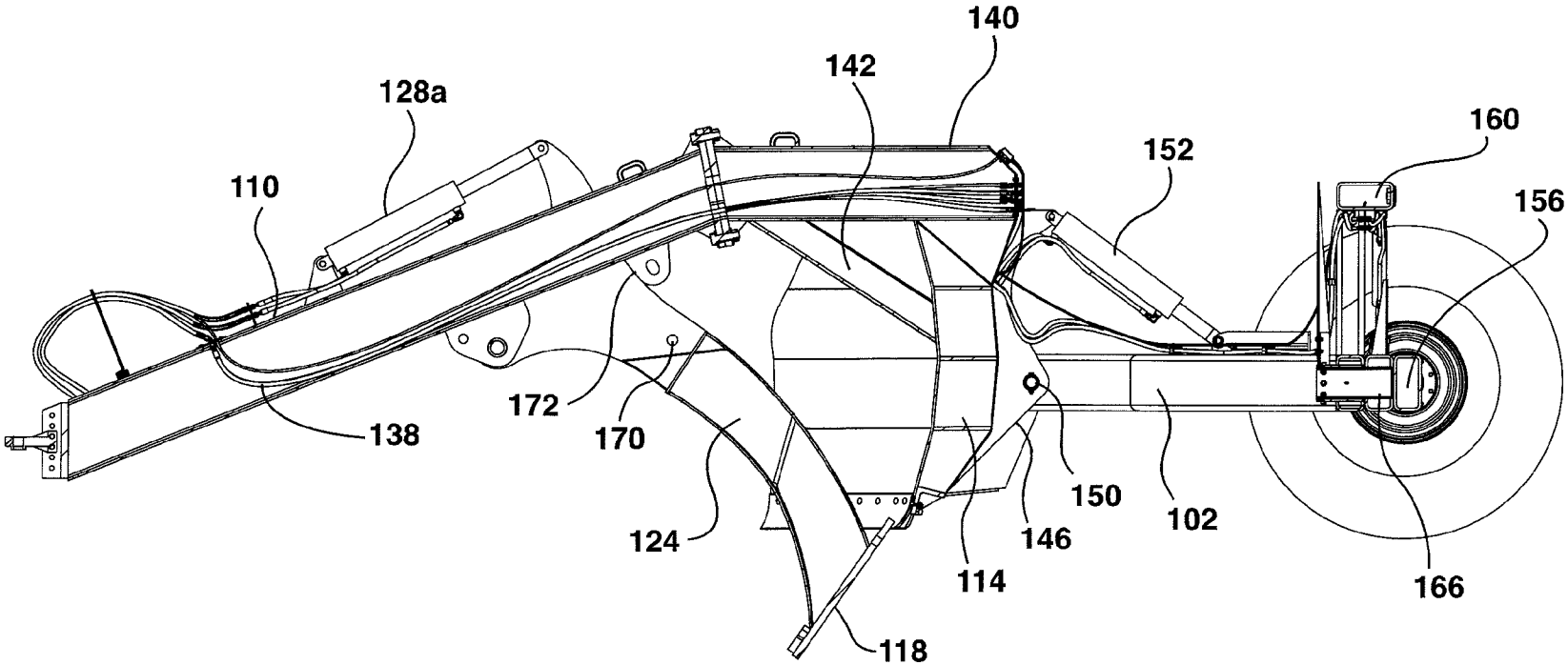
FIG. 2 depicts a cross-sectional side view through a longitudinal centerline of the earth shaping apparatus of FIG. 1.
Figure 3:
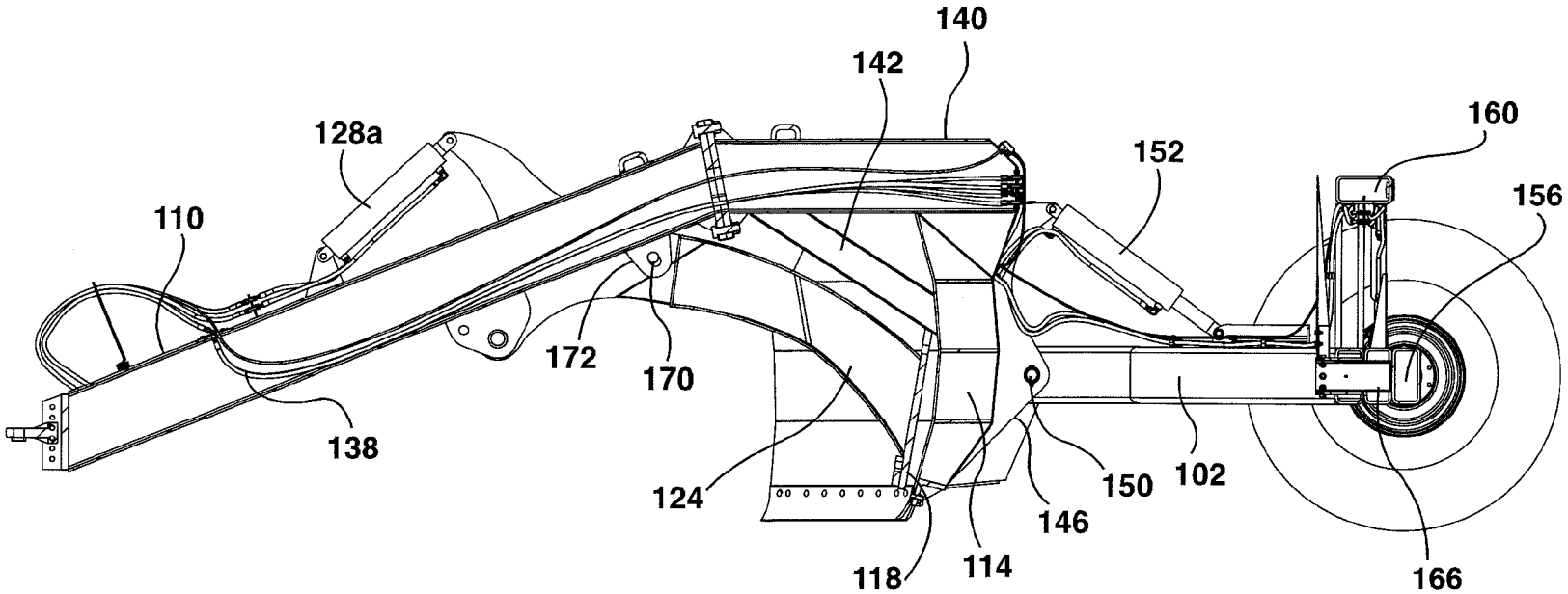
FIG. 3 depicts a further cross-sectional side view through the longitudinal centerline of the earth shaping apparatus of FIG. 1.

The ditcher 100 is pulled behind a tow vehicle. It is attached to the tow vehicle by a hitch 110. As described above, the hitch 110 provides a mounting point to the ditching leg 124. As depicted in FIG. 1, the hitch 110 may be an elongated beam or box that extends at a descending angle from a top of the leveling blade 114. The hitch 110 is located generally in the center of the leveling blade 114, although it is contemplated that other arrangements are possible. The hitch 110 has a front end 112 that is adapted to be attached to the tow vehicle. The front end of the hitch 112 can include one or more mounting points 134 for connecting an appropriate receiver 136 to the ditcher 100. Hydraulic lines 138 may pass through the interior of the hitch 110 as depicted in FIGS. 2 and 3. The hydraulic lines 138 may include appropriate couplings for connecting to a hydraulic pump (not shown) as well couplings for connecting hydraulic lines 138 to other hydraulic pistons. By running the hydraulic lines 138 inside the hitch 110, the hydraulic lines 138 may be protected from damage.

The hitch 110 may be attached to a mounting section 140 of the leveling blade 114 by a plurality of bolts. The mounting section 140 may be welded to the leveling blade 114. The connection between the leveling blade 114 and the mounting section 140 may be reinforced by one or more gusset plates 142 in order to strengthen the connection. By connecting the hitch 110 to the leveling blade 114, the connection can be made more robust. The leveling blade 114 may be required to move large amounts of earth, and as such the force acting on the connection between the hitch 110, providing the pulling force, and the leveling blade 114 may be large. With the hitch 110 connected to the mounting section 140 of the leveling blade 114, it is not possible to rotate the leveling blade 114 along a vertical axis in order to adjust the angle of the leveling blade 114 relative to the pulling direction. As depicted in FIG. 1 the leveling blade 114 is aligned substantially perpendicular to the pulling direction.

Although described as being attached to the leveling blade 114 through the mounting section 140, it is possible to connect the hitch 110 to the leveling blade 114 indirectly. For example, the hitch 110 may be connected to the frame 102, which in turn is connected to the leveling blade 114. By connecting the hitch 110 to the frame, it may be possible to adjust the angle of the leveling blade 114 relative to the pulling direction. However, if the hitch 110 is connected to the frame, the mounting structures connecting the leveling blade to the frame may need to be more robust than if the hitch 110 is connected directly to the leveling blade, in order to transfer the large forces required to move large volumes of earth.

The leveling blade 114 may be formed from a plurality of plates welded together. The leveling blade 114 may be concave in order to increase the amount of earth that can be moved. Further, the leveling blade 114 may include winged sections 144*a*, 144*b* on each end of the leveling blade 114 that extend forward from the leveling blade 114. The leveling blade 114 may be constructed as a double-walled structure to provide additional strength. The lower contacting edge 116 of the leveling blade 114 may be provided by a sacrificial blade. The sacrificial blade may be attached to the leveling blade 114 using bolts to allow easy replacement when the sacrificial blades become worn. Sacrificial blades may also be used on the winged extensions 144*a*, 144*b* of the leveling blade 114. The sacrificial blades may have a smooth edge or may be scarifying blades. The leveling blade 114 includes mounting points 146 for connecting the leveling blade 114 to the frame 102. The leveling blade 114 may be pivotally mounted to the frame 102 by mounting points 146 located on each side of the leveling blade 114. The mounting points 146 of the leveling blade 114 may each comprise a pair of plates welded to a back side of the leveling blade. The pair of plates of each mounting point are spaced apart to receive a portion of the frame 102. The frame is positioned between the pair of plates and a pivot pin 150 passes through the pair of mounting plates of the mounting point 146 and the portion of the frame received between them. Although only a single mounting point 146 is visible in FIG. 1, a second mounting point is present on the other side of the leveling blade 114.

The height of the lower contacting edge 116 of the leveling blade 114 above a ground plane may be adjusted in order to increase or decrease the amount of earth moved by the leveling blade 114. The leveling blade 114 may be mounted to the frame 102 by pivot pins 150 as described above. Hydraulic pistons 152*a*, 152*b* (referred to collectively as hydraulic pistons 152), may be used in order to rotate the leveling blade 114 about the pivot pins 150 of the connection. By rotating the leveling blade 114 about the pivot pins 150, the height of the lower contacting edge 116 of the leveling blade 114, relative to a ground plane will be increased or decreased. Typically, the hydraulic pistons 152 are operated in unison so as to rotate both sides of the leveling blade 114 at the same time. One end of each of the pistons 152 is attached to the frame 102 and the other end to the leveling blade 114. The pistons 152 may include a safety lock-out 154 that can be rotated into position on the piston 152 in order to lock the piston in the extended position, which in the embodiment depicted results in the leveling blade 114 being in the highest position. The safety lock-outs 154 may be used during transportation of the ditcher 100 to ensure the leveling blade 114 does not unintentionally lower.

If the hitch 110 is directly connected to a mounting section 140 of the leveling blade 114 as depicted, rotating the leveling blade 114 will also cause the angle of the mounting section 140, and so the hitch 110, to change. As a result, the height of the leveling blade 114 will be increased or decreased.

A horizontal angle of the leveling blade 114 may be adjusted in order to have one end of the leveling blade 114 higher than the other. This may be useful in leveling earth at a slight slope. In order to adjust the angle of the leveling blade 114, the frame 102, to which the leveling blade 114 is connected can be rotated relative to the wheels 108. The frame 102 may comprise a V' shape frame of boxed in members with each arm of the V' providing a connection point for the leveling blade 114 as described above. The bottom of the 'U' may provide a mounting point for the wheels 108. In order to allow the frame 102 to rotate relative to the wheels 108, the wheels 108 may be mounted to a sub-frame 156 that is pivotally mounted to the bottom of the 'U' of the frame 102. Hydraulic pistons 158*a*, 158*b* mounted between the frame 102 and sub-frame 156 may work in conjunction with each other in order to rotate the frame 102 relative to the sub-frame 156. Since the wheels 108 mounted to the sub-frame 156 remain aligned with the ground, the frame 102 will rotate relative to the sub-frame 156 and result in the leveling blade 114 rotating one end higher than the other. Each of the pistons 158 may have one end attached to the wheel sub-frame 156 and the other end attached to a frame member 160. The frame member 160 provides a mounting point for the pistons 158 that is located above the mounting point of the pistons 158 to the wheel's sub-frame 156 in order to allow the pistons 158 to generate the force required to rotate the frame 102 relative to the wheel sub-frame 156.

The frame member 160 may also include a measurement device for providing an indication of the amount of rotation between the frame 102 and the wheel sub-frame 156. As depicted, the measurement device may include gradation markings 162 on the frame member 160 of the frame 102 and an indicating device 164 for pointing to the gradation markings 162. The indicating device 164 is connected to the wheel sub-frame 156, or more particularly to a pivot pin 166, provided by a cylindrical pipe, that is attached to the wheel sub-frame 156 and passes through the frame 102. The pivot pin 166 allows the wheel sub-frame 156 to be rotatably attached to the frame 102. The hydraulic pistons 158 used to rotate the leveling blade 114, via the rotation of the frame 102 relative to the sub-frame 156, may also include safety lock-out devices.

As depicted in FIGS. 2 and 3, the ditching blade 118 attached to the ditching leg 124 can be retracted, as depicted in FIG. 3, completely above the lower contacting edge 116 of the leveling blade 114 or extended, as depicted in FIG. 2, into a ditching position in which the ditching blade 118 extends below the lower contacting edge 116 of the leveling blade 114. The ditching leg 124 may be locked in the retracted position for transport or when otherwise not in use. The locking mechanism may comprise a hook type latch or a securing pin that passes through holes 170 in the ditching leg and a locking plate 172 secured to the hitch 110 that are aligned when the ditching leg 124 is retracted. Other means for preventing movement of the ditching leg 124 when retracted are possible.

Figure 4:
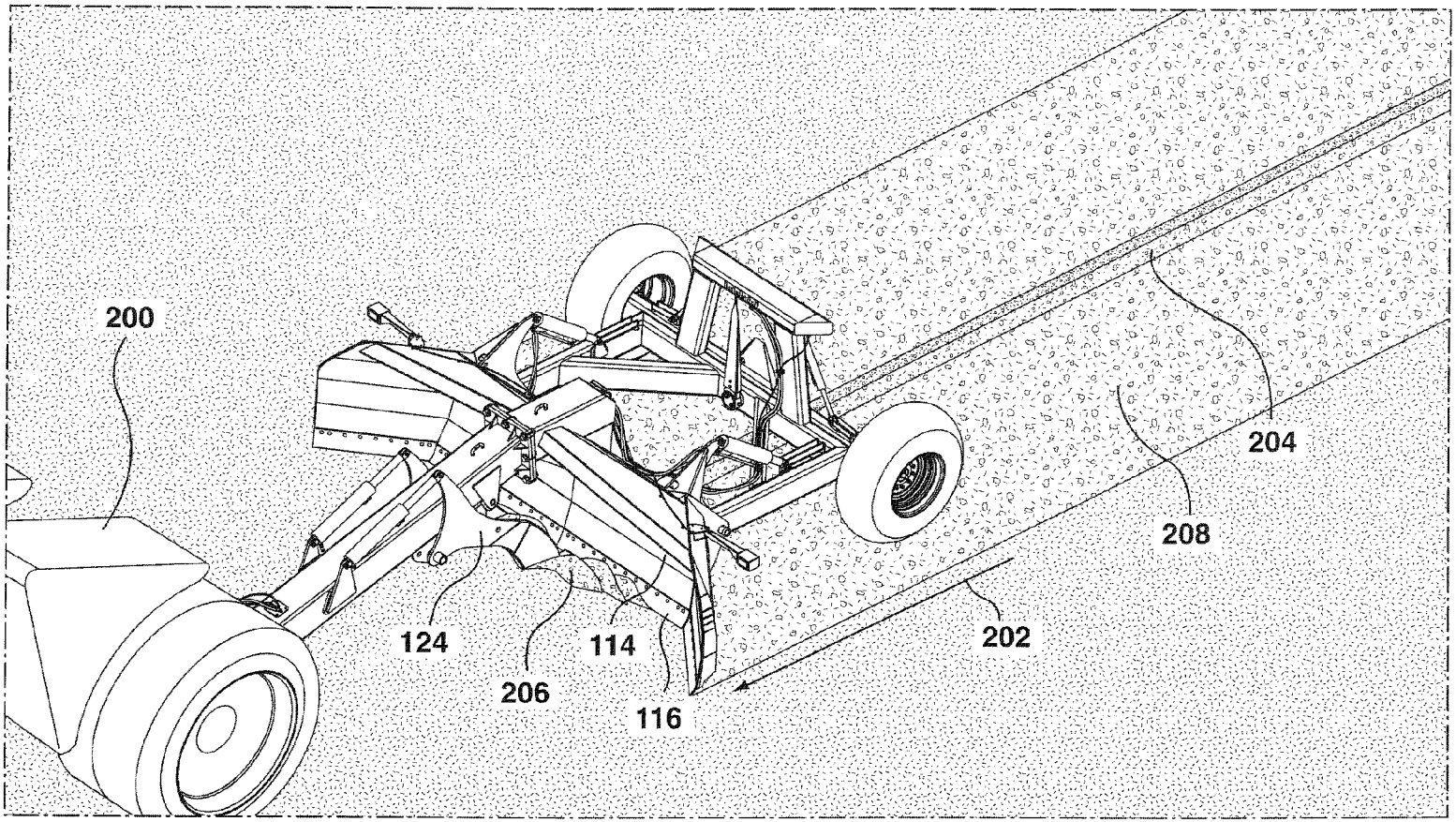
FIG. 4 depicts the earth shaping apparatus of FIG. 1 in use.

Turning to FIG. 4, the ditcher 100 may be pulled behind a tow vehicle 200 in a ditching-direction 202. With the ditching leg 124 lowered so that the ditching blade 118 extends below the lower contacting edge 116 of the leveling blade 114, a ditch 204 is excavated as the ditcher is pulled in the ditching-direction 202. The earth excavated 206 from the ditch 204 by the ditching blade 118 is then distributed by the leveling blade 114. The leveling blade 114 may also scrape the earth in order to level the ground 208 around the ditch 204. However, since the ditching blade 118 is located in close proximity to the leveling blade 114, the majority of the excavated earth 206 is prevented from falling back into the excavated ditch 204. As a result, a ditch 204 having a surrounding leveled area 208 can be provided in a single pass of the ditcher 100. The resulting leveled ditch 208,204 may provide a desired drainage ditch for a piece of land.

Figure 5:
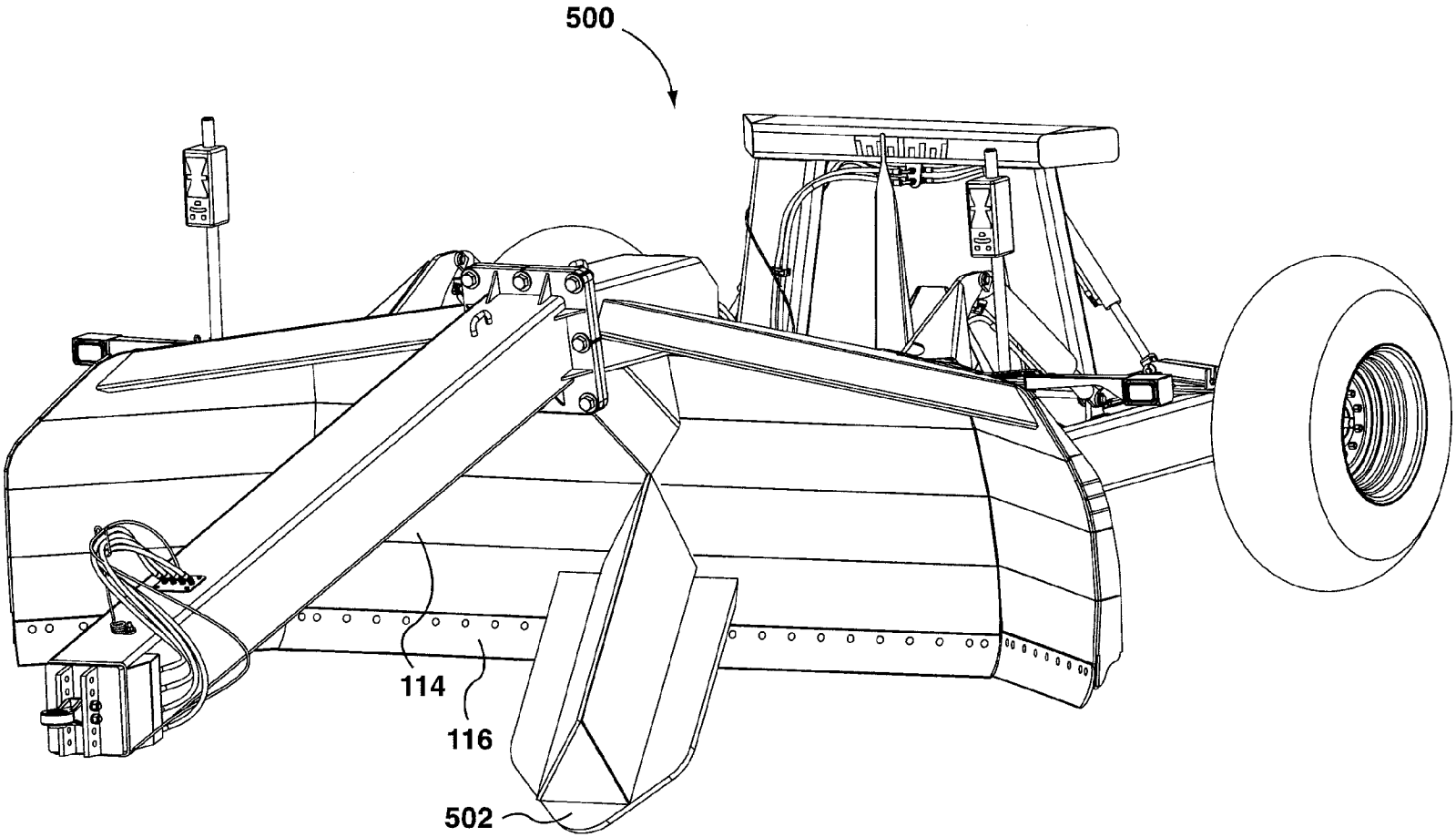
FIG. 5 depicts a further embodiment of an earth shaping apparatus.

FIG. 5 depicts a further embodiment of an earth shaping apparatus. The earth shaping apparatus 500, which is also referred to as ditcher 500 for brevity, is similar to the ditcher 100 described above, and as such only the differences will be described further. The ditcher 500 comprises ditching blade 502 that is rigidly attached to the leveling blade 114. With the ditching blade 502 rigidly attached to the leveling blade 114, it is not possible to change the amount the ditching blade 502 extends below the lower contacting edge 116 of the leveling blade 114. Although the rigidly attached ditching blade 502 reduces the flexibility of the ditcher 500, since it cannot be used as a leveler alone, it does reduce the complexity since fewer moving parts are required.

The embodiments of an earth shaping apparatus have been described above that include a ditching blade. It is contemplated that the ditching blade could be used in conjunction with existing leveling equipment, such as levelers or graders. It is contemplated that the existing leveling equipment could be retrofitted with a ditching blade in accordance with one or more of the embodiments described above.

Embodiments of a ditcher have been described that provide a ditching blade that extends below a leveling blade. The ditchers described allow a leveled ditch to be created in a single pass. Although particular embodiments have been described in detail, it will be appreciated that various modifications may be made while still providing a ditching blade that extends below a leveling blade. For example, the ditcher had been described as being pulled behind a vehicle such as a tractor. It is contemplated that the ditcher could alternatively be pulled beside a vehicle, or pushed by a vehicle. If the ditcher is pushed by a tractor, the ditching blade would not be mounted between the front end of the hitch and the leveling blade, but rather would be mounted in front of the leveling blade so that the ditching blade forms the ditch prior to the leveling blade leveling the surrounding area when in operation.

What is claimed is:

1. An earth shaping apparatus comprising:

a levelling blade having an elongated lower contacting edge and adapted to be moved in a ditching direction, the lower contacting edge arranged at an angle to the ditching direction; and a ditching blade adjustably coupled to the earth shaping apparatus in front of the levelling blade with respect to the ditching direction, the ditching blade having a contacting edge extending below the lower contacting edge of the levelling blade when in use, the ditching blade adjustable between a retracted position in which the ditching blade does not extend below the lower contacting edge of the levelling blade and a ditching position in which the ditching blade extends below the lower contacting edge of the levelling blade.

2. The earth shaping apparatus of claim 1, further comprising:

a frame;

a plurality of wheels mounted to a rearward section of the frame; and a hitch mounted to the earth shaping apparatus to allow the earth shaping apparatus to be moved in the ditching direction.

3. The earth shaping apparatus of claim 2, wherein the hitch is adapted to be pulled from a front end of the hitch, and wherein the ditching blade is located between the levelling blade and the front end of the hitch.

4. The earth shaping apparatus of claim 1, wherein an amount of the contacting edge of the ditching blade extending below the lower contacting edge of the levelling blade is adjustable.

5. The earth shaping apparatus of claim 1, wherein the ditching blade is adjustably coupled to the earth shaping apparatus to extend below the levelling blade at a center location of the levelling blade.

6. The earth shaping apparatus of claim 1, wherein the ditching blade is adjustably coupled to the earth moving apparatus to be in close proximity to the levelling blade, when the ditching blade is in use, to prevent a substantial portion of excavated earth from being pushed into the excavated ditch by the levelling blade.

7. The earth shaping apparatus of claim 1, wherein the levelling blade comprises winged extensions extending from respective sides of the levelling blade and extending forward from the levelling blade.

8. The earth shaping apparatus of claim 1, wherein the height of the levelling blade with respect to the frame may be raised or lowered.

9. The earth shaping apparatus of claim 2, wherein the frame comprises a 'U' shaped box frame with each end of the 'U' shaped box frame being pivotally attached to a respective mounting point of the levelling blade, wherein the height of the lower contacting edge of the levelling blade above the ground can be adjusted by pivoting the levelling blade about the respective mounting points.

10. The earth shaping apparatus of claim 1, wherein the ditching blade is adjustably coupled directly to the levelling blade.

11. The earth shaping apparatus of claim 2, wherein the hitch is connected to the frame.

12. The earth shaping apparatus of claim 10, wherein the levelling blade is adjustably coupled to the frame so that the angle of the lower contacting edge of the levelling blade relative to a horizontal ground surface can be adjusted.

13. The earth shaping apparatus of claim 2, wherein the hitch is connected to the levelling blade.

14. The earth shaping apparatus of claim 13, wherein the hitch is connected to the levelling blade at a center of a width of the levelling blade.

15. The earth shaping apparatus of claim 13, wherein the ditching blade is coupled to the hitch.

16. The earth shaping apparatus of claim 2, further comprising a ditching leg pivotally attached to the hitch comprising:

a pivot point for coupling the ditching leg to the hitch;

an actuating arm for allowing control of rotation of the ditching leg about the pivot point; and a bottom connected to the ditching blade.

17. The earth shaping apparatus of claim 16, wherein the ditching blade comprises a lower section having a forward facing edge for aiding in the displacement of earth from the ditch.

18. The earth shaping apparatus of claim 1, wherein the angle of the lower contacting edge of the levelling blade relative to the ditching direction is between 45° and 135°.

19. The earth shaping apparatus of claim 18, wherein the lower contacting edge of the levelling blade is generally perpendicular to the ditching direction.

20. The earth shaping apparatus of claim 1, wherein the ditching blade comprises a generally 'V' shaped contacting edge.

* * * * *